United States Patent [19]

Collins

[11] 4,049,990

[45] Sept. 20, 1977

[54] CRT IN-LINE GUN ELECTRODE HAVING STRENGTHENING RIBS

[75] Inventor: Floyd K. Collins, Seneca Falls, N.Y.

[73] Assignee: GTE Sylvania Incorporated, Stamford, Conn.

[21] Appl. No.: 731,037

[22] Filed: Oct. 8, 1976

[51] Int. Cl.[2] ..... H01J 29/50; H01J 29/82

[52] U.S. Cl. ..... 313/417; 313/458

[58] Field of Search ..... 313/417, 411, 409, 414, 313/456, 458

[56] References Cited

U.S. PATENT DOCUMENTS

| | | | |
|---|---|---|---|
| 2,810,851 | 10/1957 | Johnson | 313/456 |
| 2,859,378 | 11/1958 | Gundert et al. | 313/414 X |
| 2,888,588 | 5/1959 | Dichter | 313/458 X |
| 3,952,224 | 4/1976 | Evans | 313/414 |

*Primary Examiner*—Robert Segal
*Attorney, Agent, or Firm*—Norman J. O'Malley; Frederick H. Rinn; Robert T. Orner

[57] ABSTRACT

The invention relates to an improved planar electrode member for use in an in-line multi-beam cathode ray tube electron gun assembly. The improved electrode is a substantially planar one-piece member having a plurality of apertures therein. The side portions of the member have longitudinal strengthening bends formed therealong in conjunction with a plurality of rib embossments spatially formed as traversals crossing the member to join the side oriented bends thereby providing improved strengthening to the structure.

6 Claims, 7 Drawing Figures

CRT IN-LINE GUN ELECTRODE HAVING STRENGTHENING RIBS

CROSS REFERENCE TO RELATED APPLICATION

Filed concurrently with this application and assigned to the assignee of the present invention, is application Ser. No. 731,038, filed Oct. 8, 1976, which also pertains to one-piece in-line multi-beam cathode ray tube electrode structures.

BACKGROUND OF THE INVENTION

This invention relates to the electron gun assembly of a plural beam cathode ray tube and more particularly to ruggedizing improvement in a substantially planar electrode member utilized in a multi-beam cathode ray tube electron gun assembly.

Cathode ray tubes of the type commonly employed in color television application conventionally utilize electron gun assemblies from which a plurality of electron beams are projected to impinge the cathodoluminescent display screen of the tube. In certain gun assembly constructions, the first and second grid electrode members, such being normally control and screen grid electrodes, are often formed as substantially planar components oriented in substantially parallel planes and spaced apart superposed relationship. These electrode members are conventionally affixed to at least two longitudinal insulative support members of the gun assembly by supporting projections extending from the respective planar elements.

In multi-beam guns these planar electrodes commonly have several spatially related apertures formed therein to accommodate the respective electron beams generated within the structure. It is important that these several apertures be accurately and consistently located relative to the related apertures in adjacent electrode members, and to the respective cathode surfaces from which the specific electron beams eminate. Fabrication of the gun assembly involves embedment of supporting projections from the various electrode components into the temporarily heat-softened longitudinal insulative support members; at which time the support members on opposed sides of the assembly are pressured inward toward the electrode elements to force the supporting projections thereof into the support members. The compressive pressure tends to exert a distorting force upon the several electrode members, this being especially critical to the planar members wherein a bowing or arcuate bending effect sometimes results. Such bowing, however slight, changes the aperture locations relative to those in the adjacent electrode members, thereby producing deleterious inter-electrode spacing relationships within the gun structure. These uncontrollable changes in the related aperture spacings are particularly troublesome in in-line gun constructions wherein the first and the second grid electrode members often have related apertures of small diameters and close spacings. Since it is a common practice to utilize planar electrode elements for both the first and second grid electrodes, bowing conditions in one or both drastically aggravate the critical inter-electrode spacing characteristics resulting in pronounced inferior performance of the respective electron guns. Additionally, it has been found that a certain amount of distortion of a planar type electrode member is often aggravated by tube processing procedures and by welding pressures employed in effecting attachment of the electrode component to the associated connective lead in the gun assembly.

OBJECTS AND SUMMARY OF THE INVENTION

It is an object of the invention to reduce and obviate the aforementioned disadvantages as evidenced in the prior art.

Another object of the invention is to provide a planar electrode member having improved ruggedizing structural means therein to counteract distorting forces encountered during electron gun assembly fabrication and tube processing procedures.

A further object of the invention is to provide an improved plural electrode in-line multi-beam cathode ray tube electron gun assembly wherein the related planar grid structures are formed in a manner to optimize the maintenance of initial shaping thereby providing the desired subsequent inter-electrode spacings within the gun structure.

These and other objects and advantages are achieved in one apsect of the invention wherein there is provided an improvement in a plural electrode in-line multi-beam cathode ray tube electron gun assembly integrated by a plurality of longitudinal insulative support members. The invention relates to a substantially planar electrode member having opposed side and end portions and definitive *l-l'* and *w-w'* axes therein. A plurality of spatially positioned apertures are formed in the member and oriented on substantially the *l-l'* axis of the member. Extending from each side of the member are at least two opposed supporting projections oriented in a manner to effect attachment embedment in the insulative support members of the assembly. Each of the side portions of the electrode member has a substantially longitudinal strengthening bend formed therealong. Additionally, each member has a plurality of ruggedizing rib embossments spatially formed therein as traversals crossing the *l-l'* axis and extending between the side oriented strengthening bends in spaced relationship to the apertures. Such discrete structure provides defined strengthening of the planar member in a manner to expeditiously counteract distorting forces exerted upon the planar member during electron gun fabrication.

DESCRIPTION OF THE PREFERRED EMBODIMENTS

For a better understanding of the present invention, together with other and further objects, advantages and capabilities thereof, reference is made to the following specification and appended claims in connection with the aforedescribed drawings.

Figure 1:
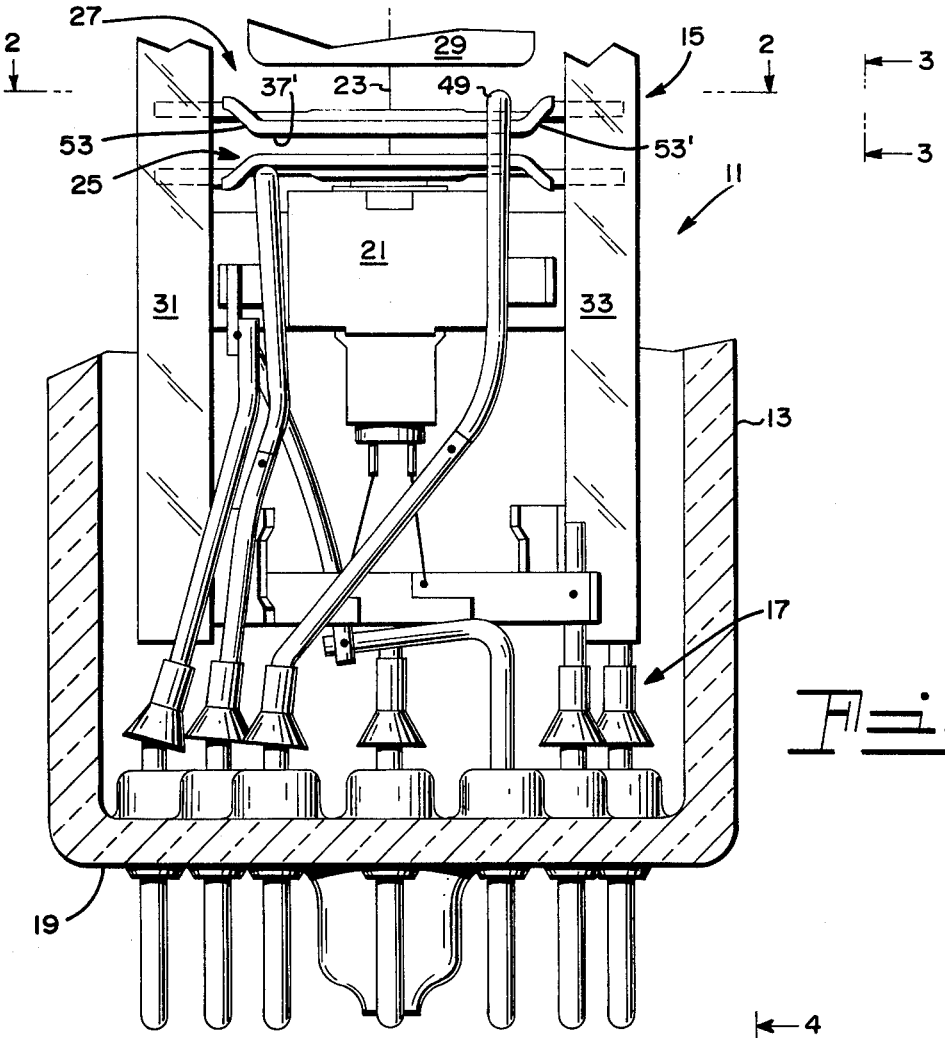
FIG. 1 is a partial elevational illustration of a section of the neck and closure regions of a cathode ray tube showing a portion of the electron gun assembly encompassed therein wherein the improvement of the invention is oriented.

With reference to the drawings there is shown in FIG. 1 a portion of a typical plural gun in-line color cathode ray tube 11 of the type employed in producing visual displays such as television and allied applications. Positionally encompassed within the neck portion of the tube 13 is a partially illustrated multi-element electron gun assembly 15 wherein a plurality of electron beams are discretely formed and individually projected toward the screen of the tube, not shown. This gun assembly, which is suitably supported on a circular array of metallic pins 17, traversing the closure of the tube 19, is comprised of an arrangement of sequentially related electrodes.

To simplify delineation of the structure, reference is directed to one of the side oriented guns of the in-line assembly, as looking into the plane of FIG. 1, wherein starting with the closure end 19 of the tube, a first electrode adjacent thereto is a cathode assembly structure 21 containing an indirectly heated cathode which generates electrons to form the respective beam 23. Sequentially positioned forward therefrom is a control grid electrode 25 which forms or modulates the electrons into the beam, whereupon it is initially accelerated by the influences of a screen grid electrode 27. The partially shown third grid electrode 29 provides focussing, and a fourth or high voltage terminal grid electrode, not shown, imparts final velocity or acceleration to the beam. The respective electrode arrangements comprising the gun assembly are affixed to and supported by a plurality of at least two longitudinal insulative support members, such as 31 and 33 shown.

In the exemplary electron gun assembly 15, the control and screen grid electron members 25 and 27 are shown as being substantially similarly formed one-piece planar structures oriented in inverted relationship. It is to this type of planar electrode structure that the present invention is directed. As shown, structural rib-like features are discretely incorporated in the formation of this one-piece planar member to provide markedly improved ruggedizing characteristics.

Figure 2:
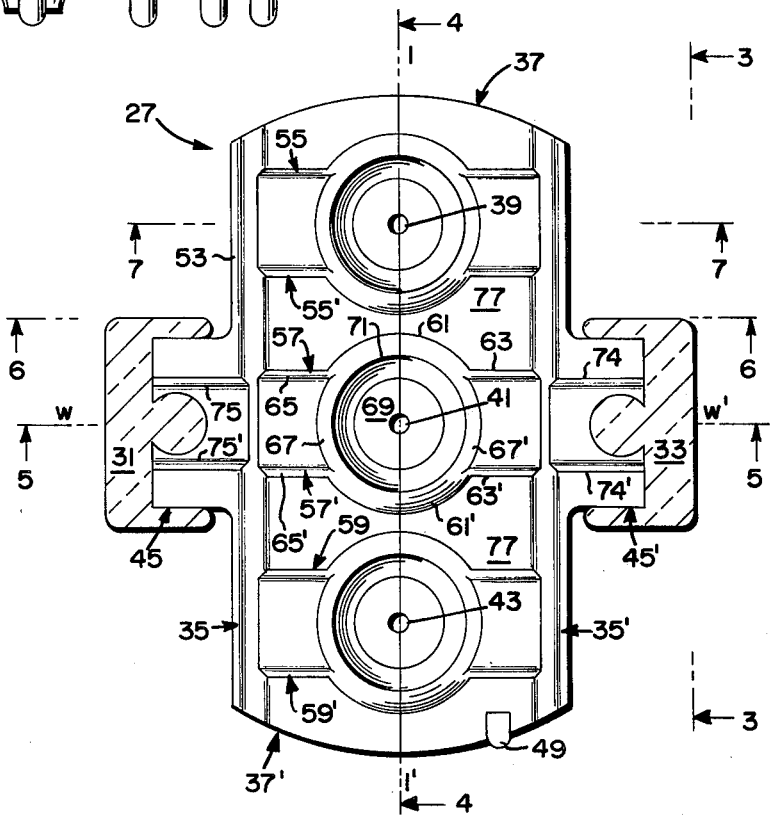
FIG. 2 is a plan view of the improved planar electrode structure of the invention taken along the line 2—2 of FIG. 1.
Figure 3:
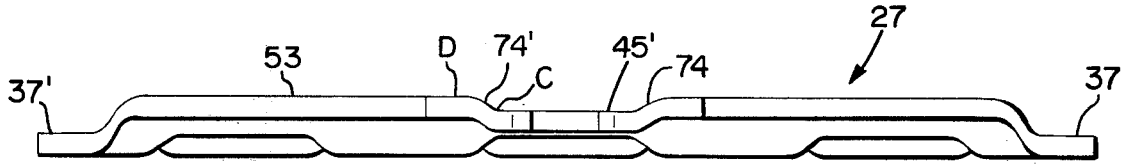
FIG. 3 is a side view of the improved planar electrode structure taken along the line 3—3 of FIGS. 1 and 2.
Figure 4:
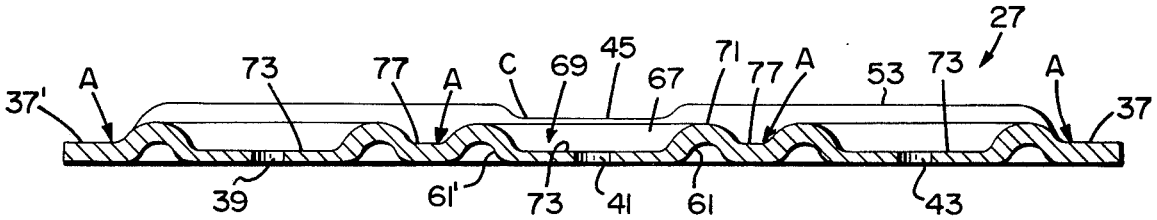
FIG. 4 is a sectional view of the improved structure taken lengthwise along the *l-l'* axis or line 4—4 of FIG. 2.
Figure 5:
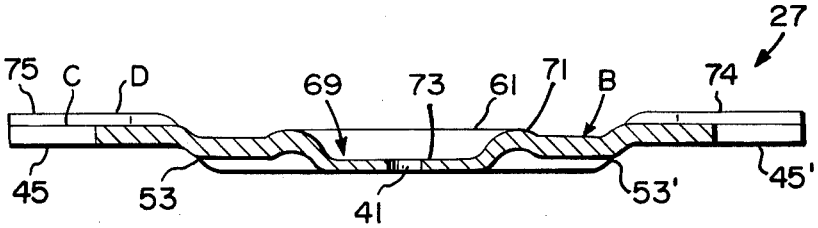
FIG. 5 is a sectional view of the electrode structure taken widthwise along the *w-w'* axis or line 5—5 of FIG. 2.

In greater detail, reference is directed to FIG. 2 which delineates a plan view of the screen grid electrode 27, such being an example of the improved planar electrode structure of the invention. This one-piece substantially planar metallic member 27 has distinguishing opposed side portions 35, 35' and end portions 37, 37' which evidence strengthening features. Definitive lengthwise *l-l'* and widthwise *w-w'* axes are provided to aid in description of the member, whereof the cross-sectional configurations are shown in FIGS. 4 and 5 respectively. Spacedly formed therein are a plurality of in-line beam related apertures such as 39, 41 and 43 which are oriented in a common plane on substantially the *l-l'* axis. In the present instance, the center one of these apertures 41 is located at the intersection of the aforementioned *l* and *w* axes. Additionally, this planar member 27 has opposed supporting projections 45, 45' extending from either side 35, 35' thereof in a positional manner for attachment to the respective insulative assembly support members 31 and 33. This affixture is accomplished during electron gun assembly fabrication wherein the longitudinal glass support members are selectively heated to a softened stage, whereupon they are pressed against the carefully positioned electrode supporting projections to consummate firm embedment of the projections within the support members.

Typically within the completed gun assembly, electrical connections between the electrode 27 and the respective associated connective lead 49 is affected by suitable bonding therebetween.

With further reference to the figures, on each side of the electrode member 27 there is formed a substantially longitudinal strengthing bend, such being substantially parallel with the aforementioned *l-l'* axis. Additionally, the planar member has a plurality of rib embossments, such as 55, 55', 57, 57', 59 and 59', spatially formed therein as traversals crossing the *l-l'* axis and extending therebeyond between side oriented strengthening bends 53, 53' in spaced relationship to the respective apertures. More explicitly, each of the aperture areas has a pair of rib embossments spatially associated therewith, as for example, ribs 57 and 57' which are related to aperture 41. Each of these ribs is substantially formed as a yoke configuration having, for example, an intermediate arcuate section 61 from which two extremital sections 63 and 65 opposedly extend in a substantially common linear relationship. The arcuate sections of the pair of yoke-formed ribs 61 and 61' are oriented in a spatial cirumferential relationship to a respective aperture, which in turn, has augmenting arcuate rib embossings 67, 67' formed thereabout in a manner to merge with the arcuate sections 61, 61' of the yoke embossments to form a dish-like encompassment 69 of the respective aperture 41. Each dish-like formation has a peripheral apex 71. As illustrated in FIGS. 4 and 5, the bottom or apertured area 73 of the dish-like formation 69 may be coined to a reduced thickness. The pair of rib embossments 57 and 57', which are associated with the aperture 41 located at the intersection of the *l* and *w* axes, have extremital sections 74, 74' and 75, 75', co-extending into the respective opposed supporting projections 45 and 45' protruding from the sides of the member. Such continuing embossments provide marked strengthening to the supporting projections.

The exemplary extremital sections 63, 63', 65, 65' of the traversally oriented rib embossments are substantially parallel to the *w-w'* axis of the member. The terminations of these extremital sections merge with the side related longitudinal bends 53 and 53' to provide additional angular structural strengthening for the electrode member.

Figure 6:
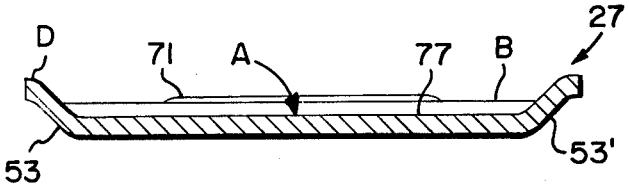
FIG. 6 is a sectional view of the electrode taken along the line 6—6 of FIG. 2.
Figure 7:
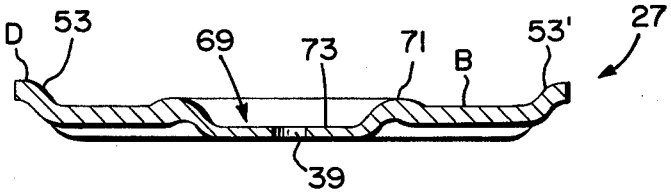
FIG. 7 is a sectional view of the electrode member taken along the line 7—7 of FIG. 2.

As delineated in FIG. 4, the improved planar member 27 is formed in a manner that the end portion 37, 37' of the member and the inter-region 77 separating the respected apertures are all substantially of a common primary planar level "A". In referring to FIGS. 5, 6 and 7, a common second planar level "B" is noted in traverse relationship with the aperture region; while common third and fourth planar levels "C" and "D" respectively are asssociated with each of the supporting projections 45 and 45' in a manner to provide strengthening thereto. The rib embossments of the invention are discretely placed to provide a planar electrode member that evidences improved ruggedizing structural features which effectively counteract the traversely-oriented distorting forces that are encountered during electron gun assembly fabrication and subsequent tube processing. Thus, the ruggedizing features of the invention provide an improved one-piece planar electrode structure that maintains desired positioning within the electron gun assembly.

While there has been shown and described what are at present considered the preferred embodiments of the invention, it will be obvious to those skilled in the art that various changes and modifications may be made therein without departing from the invention as defined by the appended claims.

What is claimed is:

1. An improvement in a plural-electrode in-line multibeam cathode ray tube electron gun assembly integrated by a plurality of longitudinal insulative support members, said improvement comprising:

a substantially planar one-piece electrode member having opposed side and end portions and definitive *l-l'* and *w-w'* axes therein, said member having a plurality of spatially positioned and in-line related apertures therethrough such being oriented in a common plane substantially the *l-l'* axis of said member, one of said apertures being located at the intersection of said *l* and *w* axes, said planar member having at least two opposed supporting projections extending from either side thereof in a positional manner for attachment to said assembly support members, each of the side portions of said electrode member having a substantially longitudinal strengthening bend therein, each of the aperture areas in said member having a pair of rib embossments spatially associated therewith, each of said ribs being substantially formed as a yoke configuration having an intermediate arcuate section from which two extremital sections opposedly extend in a substantially common linear relationship, the arcuate sections of said pair of yoke-formed ribs being oriented in spaced circumferential relationship to a respective aperture, the pair of rib embossments spatially associated with said aperture located at the intersection of said *l* and *w* axes have extremital sections thereof co-extending into the respective opposed supporting projections protruding from the sides of said member to provide strengthening thereto.

2. The improved planar electrode member according to claim 1 wherein the extremital sections of said rib embossments are substantially parallel to the *w-w'* axis of said member.

3. The improved planar electrode member according to claim 1 wherein each of said apertures has augmenting arcuate rib embossing formed thereabout in a manner to merge with the arcuate sections of said yoke embossments to form a dish-like encompassment of each aperture.

4. The improvement planar electrode member according to claim 1 wherein the terminations of said extremital sections angularly merge with said side-related longitudinal bends to provide additional structural strengthening for said member.

5. The improved planar electrode member according to claim 1 wherein the end portions of said member, said aperture regions and the inter-regions separating said apertures are all substantially of a common planar level.

6. The improved planar electrode member according to claim 5 wherein said supporting projections are substantially of a planar level differing from said common planar level.

* * * * *